US007458583B2

(12) United States Patent
Wilson

(10) Patent No.: US 7,458,583 B2
(45) Date of Patent: Dec. 2, 2008

(54) METHOD OF PLAYING A GAME OF WAR

(75) Inventor: Tammy L. Wilson, Lawrenceville, GA (US)

(73) Assignee: Vision Gaming & Technology, Inc., Norcross, GA (US)

( * ) Notice: Subject to any disclaimer, the term of this patent is extended or adjusted under 35 U.S.C. 154(b) by 174 days.

(21) Appl. No.: 11/122,957

(22) Filed: May 5, 2005

(65) Prior Publication Data

US 2005/0275167 A1 Dec. 15, 2005

Related U.S. Application Data

(60) Provisional application No. 60/578,454, filed on Jun. 9, 2004.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 1,982,534 A * 11/1934 Parker ..... 273/306
5,324,041 A * 6/1994 Boylan et al. ..... 273/292
5,720,484 A * 2/1998 Hsu ..... 273/292
5,816,916 A * 10/1998 Moody ..... 463/13
5,916,024 A * 6/1999 Von Kohorn ..... 463/40
6,102,403 A * 8/2000 Kaufman ..... 273/292
6,443,840 B2 * 9/2002 Von Kohorn ..... 463/17
6,585,588 B2 * 7/2003 Hartl ..... 463/16
6,789,801 B2 * 9/2004 Snow ..... 273/292

* cited by examiner

*Primary Examiner*—Gene Kim
*Assistant Examiner*—Dolores Collins
(74) *Attorney, Agent, or Firm*—Sand & Sebolt

(57) ABSTRACT

A method of playing a card game based broadly on the game of WAR wherein the higher card wins when a player card in matched against a dealer card. The game includes dealing multiple cards such as 3, 5, 7, etc. to each of the dealer and player for matching against each other. The player must win a majority of the individual card matches to win. In the event of a tie a War Round is declared and three cards are dealt face down to the player and to the dealer, and one card dealt face up to both the player and the dealer. If the dealer wins the War Round by having a greater value up card the game is terminated. If the player wins, bonus points are awarded to the player based upon the value of the face down cards. Greater bonus points are also awarded if the player wins the War Round with an Ace. Another secondary Bonus Round is played if the player wins the War Round with a Joker. The War Round and initial multiple card game are temporarily interrupted, but maintained while the Bonus Round is played. In the Bonus Round the player is awarded additional points by selecting a number of cards from a face down deck of cards. The method preferably is performed as an electronic video game with a touch screen.

20 Claims, 6 Drawing Sheets

METHOD OF PLAYING A GAME OF WAR

CROSS REFERENCE TO RELATED APPLICATIONS

This application claims priority from U.S. provisional application Ser. No. 60/578,454 filed Jun. 9, 2004; the disclosure of which is incorporated herein by reference.

BACKGROUND OF THE INVENTION

1. Technical Field

The present invention relates to card games, and in particular to card games utilizing high-low wagering with a standard or modified deck of playing cards, known as the game of WAR. More particularly, the invention relates to such a WAR like game adapted primarily for use as an electronic video game which includes placing a wager and a payoff to the player in the event he/she is victorious.

2. Background Information

There are numerous types of card games, many of which have been incorporated into video gaming machines, such as the various types of Poker, Blackjack, etc. wherein the player deposits a certain amount of money or credits into the video gaming machine and interacts with a computer controlled viewing screen, and by either use of a touch screen or play buttons on the video game, controls some aspect the outcome of the game and plays against a dealer or gaming machine. One type of game is the game of WAR wherein a dealer and player match individual cards one-to-one, and the holder of the matched cards having the highest rank is declared the winner. In a non-gaming situation the winner collects the cards of the opponent, and in a gaming situation, such as a video slot machine game, will win either bonus points, which correspond to a value of money based upon the initial bet placed by the player at the start of the game, or an immediate monetary payout. The game of WAR is presently being played actively in casinos with a live dealer who deals the cards to the player and himself after a bet has been placed on the table. Some examples of these types of games are shown in U.S. Pat. Nos. 1,982,534; 5,324,041; 5,720,484; 5,816,916; and 6,102,403.

However, it has been found that playing a single game of WAR, wherein one card is dealt to each player which constitutes the game, either on a video slot machine game or with a live dealer, does not hold the players interest since the game is over extremely quick and becomes monotonous. Therefore, the need exists for an improved card game, and in particular an improved WAR type card game, either played with a live dealer or in a video slot machine, which involves more than the dealer and player each receiving a single card in each game, in order to maintain the player interest and increase the pleasure to the player, and increase play in the casino.

BRIEF SUMMARY OF THE INVENTION

One aspect of the invention is to provide a card game based upon the game of WAR wherein a dealer's card is compared against the player's card, and the card with the higher point value is the winner, together with increased playing possibilities and activity for each game, and the chance for a greater payout to the player.

Another feature of the present invention is to provide a video card game in which the player can select the number of cards to be played in each game, such as three cards, five cards, seven cards, etc., so that it increases the suspense to the player in a single game then that occurs when only a single card is dealt to each of the player and dealer.

A further feature of the present invention is to deal a greater number of cards then that selected by the player and expose the values thereof in order to entice the dealer to play additional cards in the next game, thereby increasing his bet and hopefully the profit of the casino or video slot machine game owner.

Another feature of the game is that the player or dealer who wins the majority of the matching pairs of the dealt cards is the winner.

Still another aspect of the present invention is that in the play of the game, a WAR is declared when the value of the dealer's card matches the value of the player's card being matched thereagainst. A War Round then is played, with three cards being dealt face down to each of the dealer and the player, and a card dealt face up to each, with the higher ranking up card winning the War Round, and wherein the player is awarded points based upon the value of the face down cards of the player and/or dealer depending upon the value of the particular up card of the player's winning card.

A further aspect of the present invention is to provide a WAR type game wherein if the player wins a War Round with a Joker or similar Wild Card as the up card, a Bonus Round is presented to the player wherein the player selects a number of face down cards in a standard deck of cards containing two Jokers and is awarded points based upon the selected cards, with the number of cards chosen being dependent upon the initial bet by the player. This provides the player with a chance of winning considerably more as a "bonus" instead of the amount won in a usual high-low card match game.

These objectives and features are obtained by the method of the present invention, the general nature of which may be stated as including the steps of the player making a wager to begin play the game, the player selecting the number of cards to be played, said number being a minimum of three cards or a greater uneven number thereof, dealing at least the number of selected cards to the player and the same number of cards to the dealer, with each dealer card corresponding to a card of the player, comparing each card of the dealer to the corresponding card of the player wherein the higher ranking card of each pair of compared cards wins, and if the player is the winner of the majority of compared cards, the player is awarded an amount of reward points based upon the amount of the wager.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
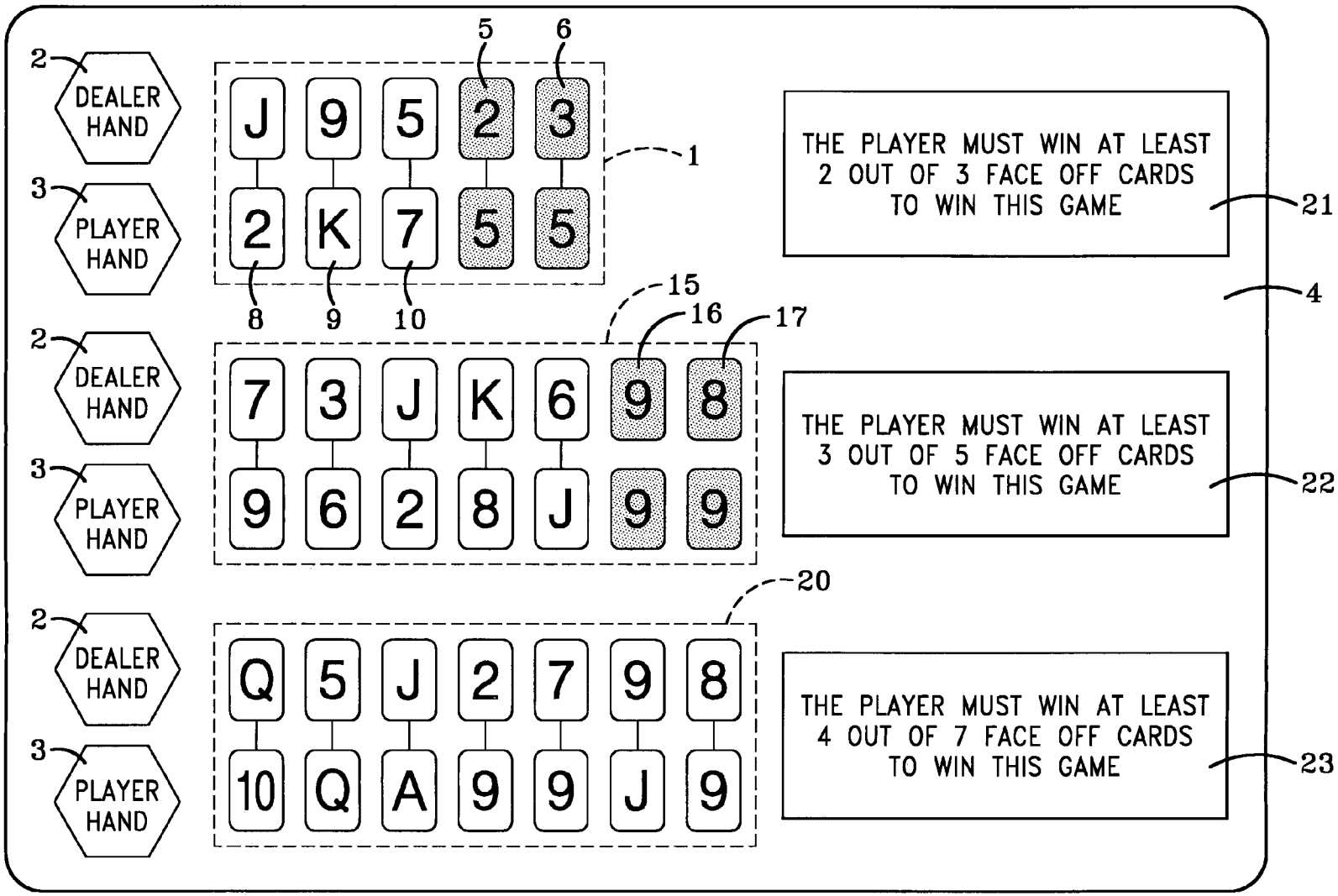
FIG. 1 shows three separate views that would be displayed on a video screen of an electronic gaming machine depending upon the number of cards in a card package selected by the player at the start of the game.

The method for playing the game of the present invention is shown in the above discussed drawings, and discussed below. A player, especially in a wagering environment, such as a casino or other location where a video gaming machine is used for playing the game, will deposit a certain amount of money to play the game. The player then will select a card package, that is, a certain number of cards to be dealt, such as three cards, five cards, or seven cards as shown in FIG. 1. Thus, the player is betting on a deal of three, five, or seven cards with each wager. The amount of the wager will increase for each card package selected. After the wager is made, such as by depositing a coin or pressing a button to remove credits already installed in the gaming machine, the selected number of cards will appear on the screen. For example, a three card package, which may show five cards each, as discussed below, is shown in dot dash block 1 which may fill the entire viewing screen 4. It may also designate which is the dealer hand or player hand as shown by blocks 2 and 3. Even if the player selects to play a three card package the screen may show a five card package, as shown in block 1, with the non-selected two cards 5 and 6 being presented in a fashion manner than that of the three cards to be played, represented by cards 8, 9, and 10, such as having a grey background.

Thus, for the first play where the dealer selects to play a three card package, five cards will appear as shown in dot dash block 1. The cards will all be face up at the start of the game, indicating immediately who is the winner. The player must win at least two of the three hands, such as shown in block 1, to win the game. When this occurs, the player is awarded bonus points which will be posted at some location on the machine based upon the amount of wager the player has bet or a monetary payout. Should the player elect to play a five card package, such as shown within dot dash block 15, seven cards may be shown instead of five, with the non-elected two cards 16 and 17 having the different background. These additional cards 16 and 17 are being shown to entice the player to play more cards per hand, which will usually require a larger wager at the start of the game. The player must win three out of the five card matches as shown in block 15 to win the game.

Block 20 represents a seven card package, which requires the player to win four of the seven individual card face offs to win the game. As shown in block 20, the player wins six of the seven hands. In this situation, the player will win bonus points since he/she wins more than a mere majority of the individual face offs. This equates to more money in a gaming situation, than if the player merely wins four of the seven hands. Likewise, if the player wins five of seven hands, six of seven hands, etc., it will affect the amount of points (money) awarded to the winner. This individual payoff feature will be the same for block 15 should the player win four of five or five of five individual face offs. It is this chance of winning more hands and more money than a mere majority with a lesser payoff, which entices the player to request a larger number of cards in each play of the game than just the minimum three card package as shown in block 1. However, this also will require that a larger wager be made at the start of the game.

The particular play of the cards, as shown in FIG. 1, will be obtained from a usual fifty-two deck of cards in a usual video game computer, and it is understood that the higher ranking card wins the particular two card match-up. For example, in block 20 the player's Ace wins over the Jack, the nine wins over the seven, etc. The particular electronic equipment for performing these functions is easily developed by one skilled in the computer controlled video gaming art, and thus is not shown in detail.

The dealer and player blocks 2 and 3 may appear on the screen in order to assist in the play of the game, but is not required. Likewise, blocks 21, 22, and 23 containing various printed indicia explaining the rules and play of the game may appear on the screen when the cards are dealt or be permanently posted at another location on the video game.

Figure 2:
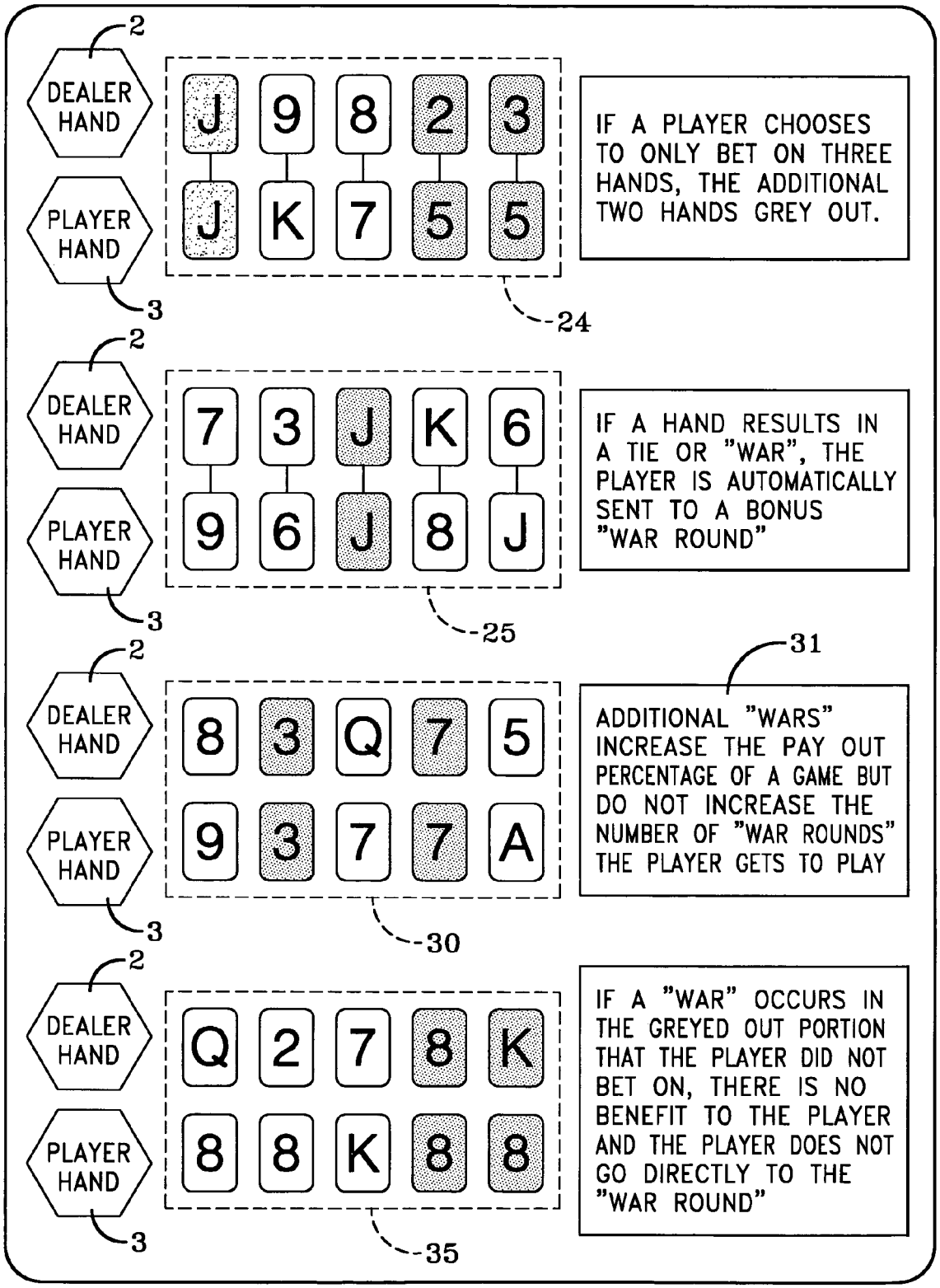
FIG. 2 is a view similar to FIG. 1 showing four simulated card packages and the played cards resulting in a tie or War Round being declared.
Figure 3:
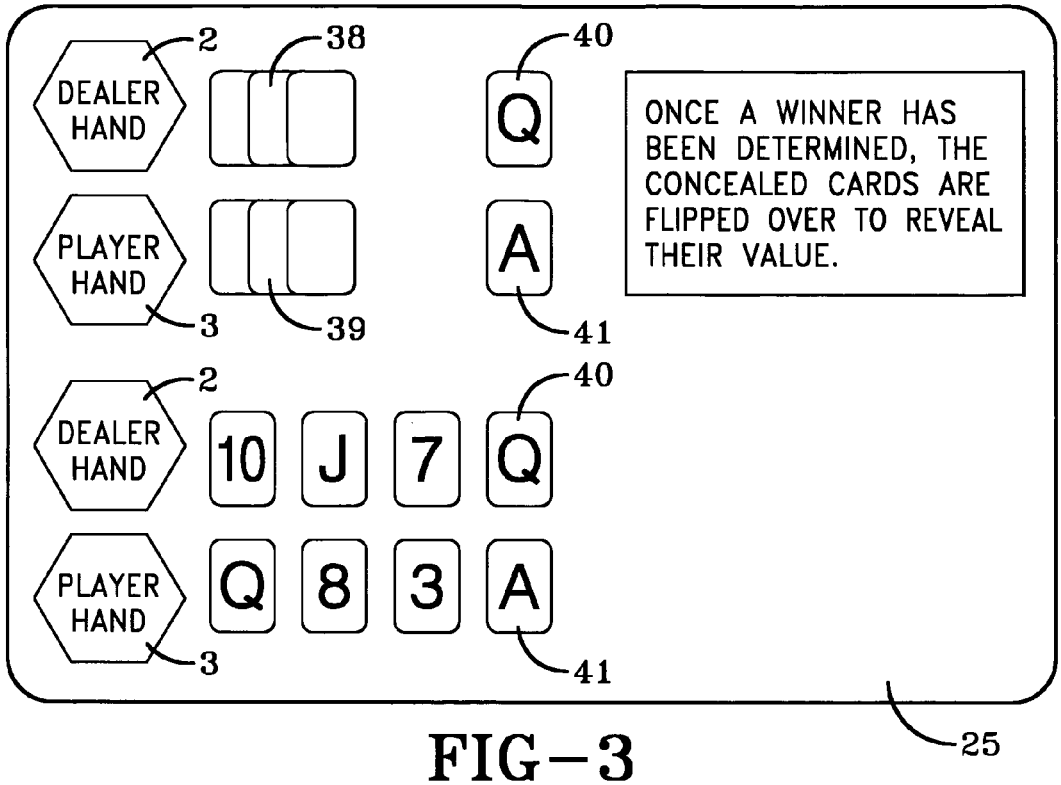
FIG. 3 is a view showing the video screen presented to the player and subsequent play of a War Round.

In all games of high-low cards wherein one player's card is matched against the other player's card, a tie will often result which causes a WAR to be declared. This situation is represented in FIG. 2 which shows in block 24 that the Jacks are tied and a WAR is declared. This may be indicated on the screen by a different colored background appearing about the Jacks. However, even if a tie exists in a hand, such as shown in block 24, should the dealer win the other two face off hands (not shown) the game is terminated and the dealer wins. However, if the player wins one or both of the other two hands, play advances to a War Round as shown in FIG. 3. Block 25 (FIG. 2) shows an example where a five card package results in a WAR due to the tie of Jacks and will proceed to the War Round as in block 24, since the player has won three of the remaining four card pair face offs.

As shown in another example in block 30, two ties result, enabling the player to advance to the War Round since the player has won two out of the three remaining non-tie hands. However, as indicated in block 30, which may or may not appear on the video screen, only one War Round is played as discussed further below, even when two ties result. However, this may increase the payout or the award of bonus points to the player.

Dot dash block 35 shows a tie occurring in the non-elected greyed-out portion of the cards, where the player only played a three card package, and even though he wins two out of three, he still wins the initial game, but does not advance to the War Round since the tie occurred in one of the greyed-out (non-selected) cards. Thus again, the showing of these two additional non-selected cards entices the player to select more than just a three card package at the start of the game in order to increase the chances of having a tie in order to advance to a War Round and subsequent Bonus Round discussed further below, where greater rewards are possible.

Figure 4:
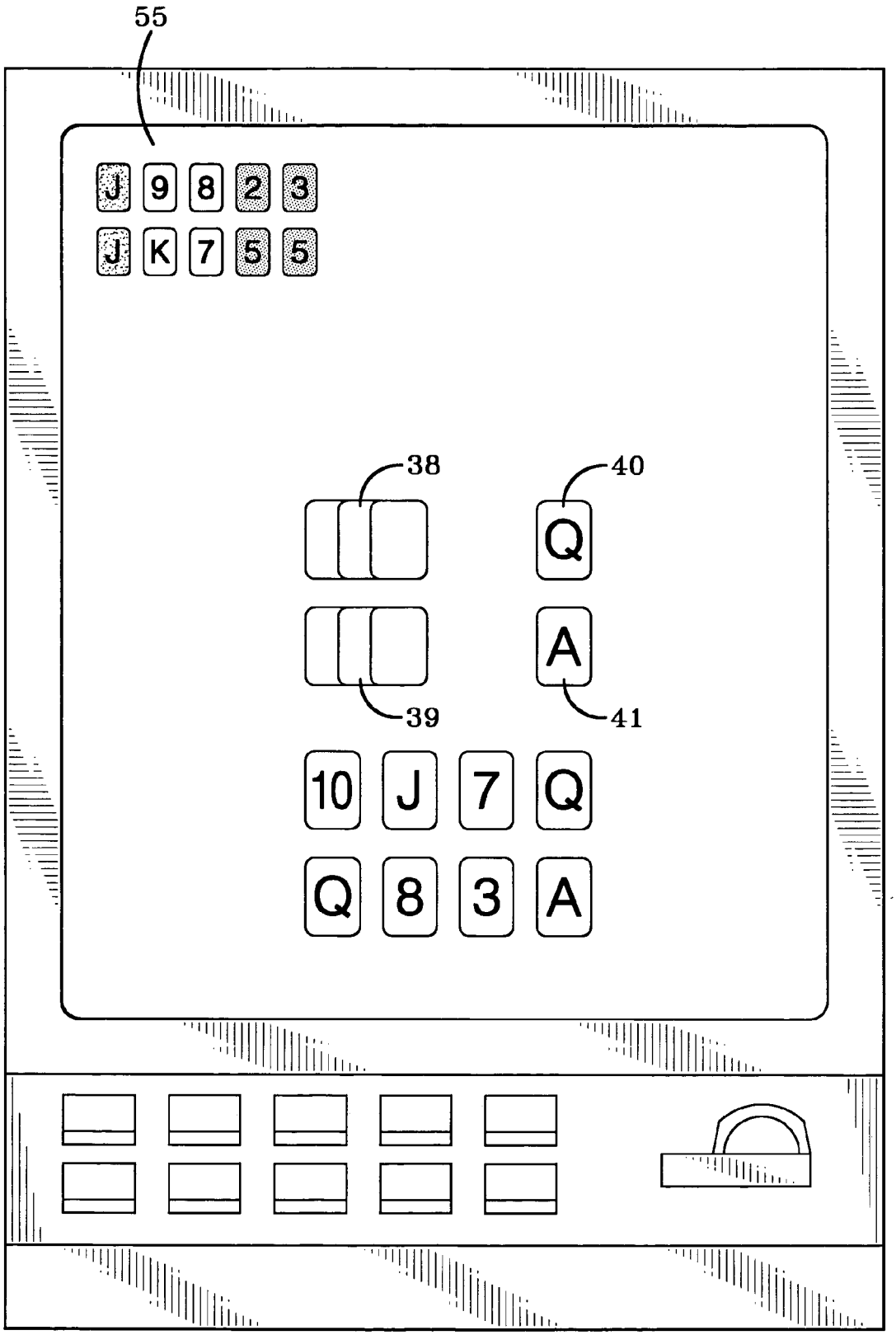
FIG. 4 is a diagrammatic view of a video slot machine game showing the War Round being played thereon as shown in FIG. 3.

Upon a tie occurring, as in block 24 wherein the player wins at least one of the remaining two card play offs, the machine automatically advances to the War Round as shown in FIGS. 3 and 4. The computer will deal three cards face down as indicated at 38 to the dealer, and three cards face down as indicated at 39 to the player. The computer will also deal one face up card 40 to the dealer and one face up card 41 to the player. The winner of the War Round is determined by the higher ranking face up card. In the example shown in FIG. 3, the player wins the War Round since the Ace is a higher ranking card than the Queen. Next the three face down cards are revealed as shown in the lower portion of FIG. 3, which depending upon the value of the player's winning face up card 41, will determine the amount of points awarded to the player.

Should dealer card 40 be higher ranking than player card 41, the game is automatically over, but the player could still win bonus points if the player won the majority of the other hands, for example, three or four of the remaining hands in the five card package of block 25, or two out of three non-tied remaining hands in block 30. However, the player would not win if the remaining non-tied hands are equal, such as shown in block 24 wherein the dealer wins one hand versus one hand won by the player in a three card hand.

In accordance with another of the features of the invention, if the player wins the War Round with an Ace as shown in FIG. 3, the player wins the value of the cards in both the dealer's hand as well as the player's hand. If the player wins with a card other than an Ace or wild card, the player only wins the value of the cards in his/her hand. For example, either the face value of the cards plus ten for picture cards and the value assigned for the Ace. Thus, winning a War Round with an Ace is considerably more profitable to the player than winning with another higher card 41.

FIG. 4 represents the one possible view that the machine screen will show after a War Round has been declared and played, with the initially dealt cards of the selected package being shown in a reduced size in a corner 55 of the viewing screen and the War Round being shown in a larger size in the center of the video screen.

Figure 5:
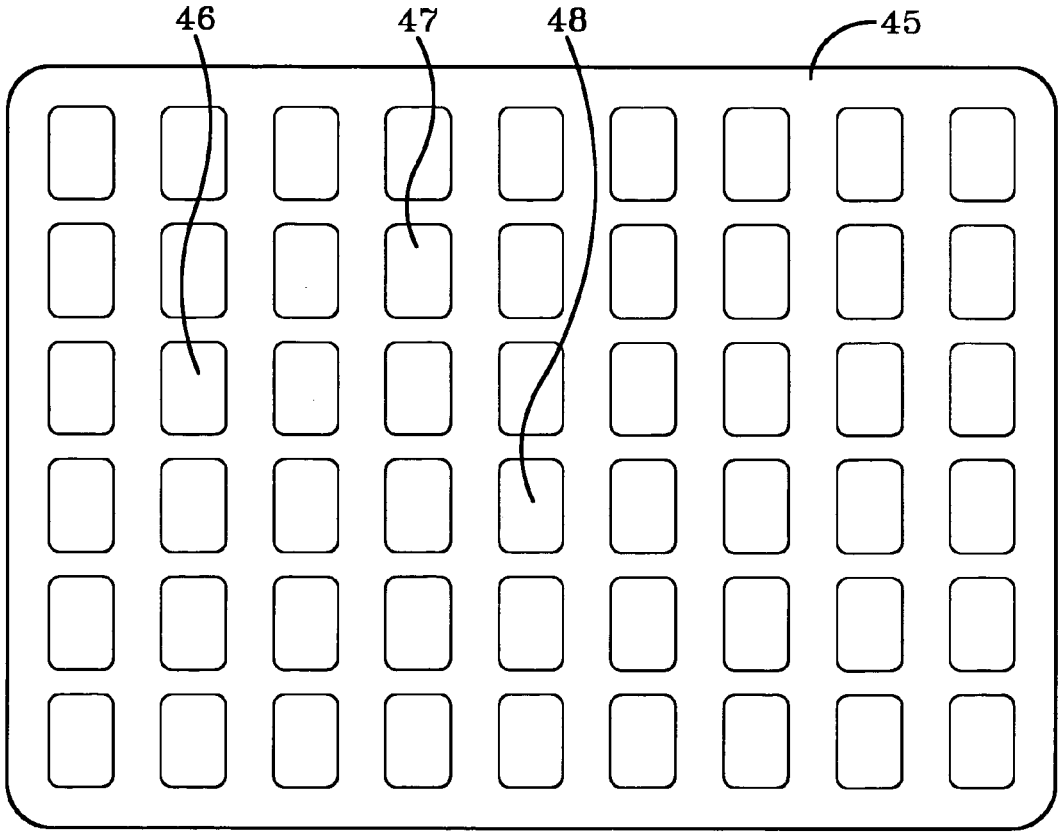
FIG. 5 is a partial view of the video game screen that appears if a player enters a Bonus Round based upon the results of the War Round of FIGS. 3 and 4.
Figure 6:
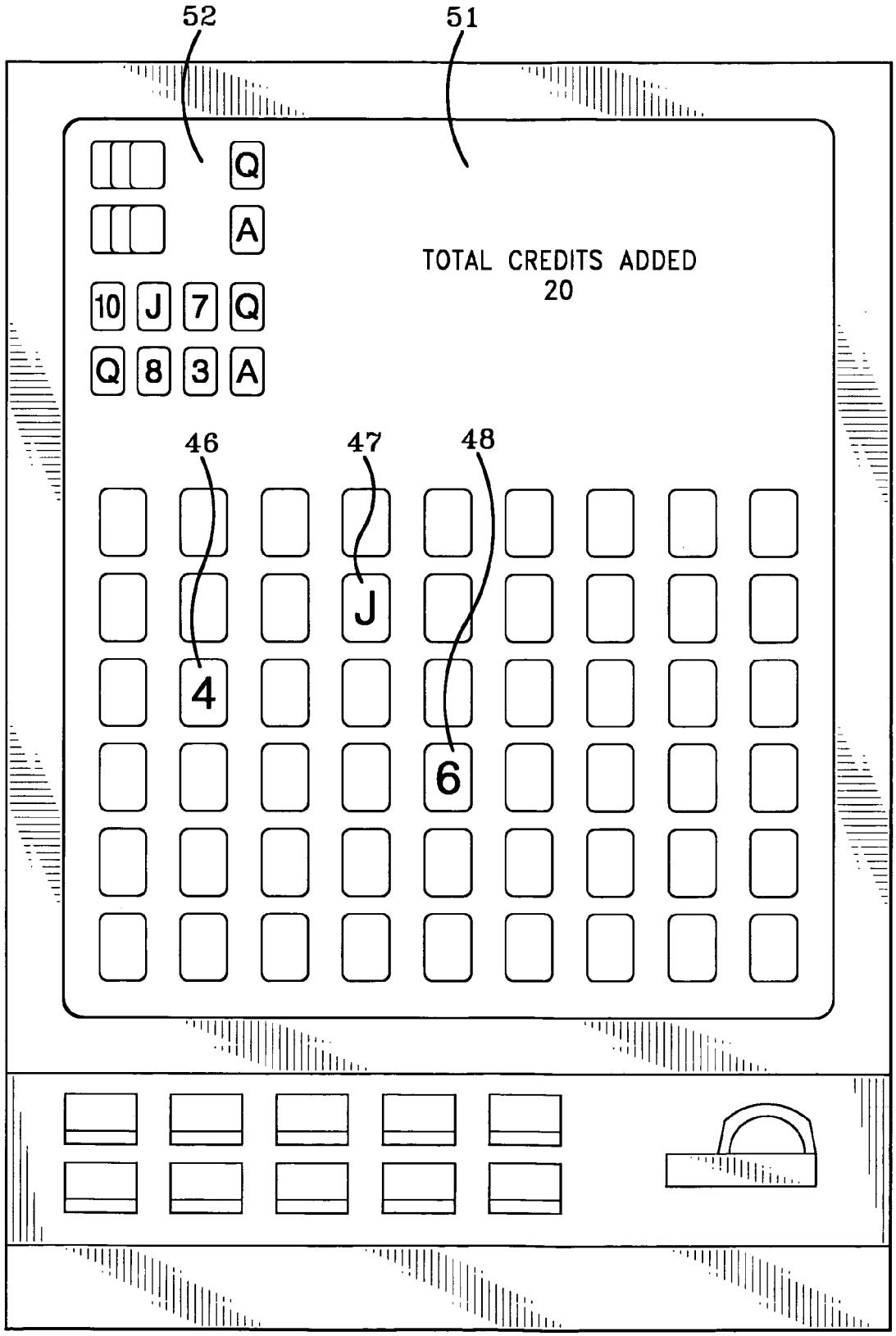
FIG. 6 is a diagrammatic view of a video slot machine game showing the cards selected by the player at the start of a Bonus Round.
Figure 7:
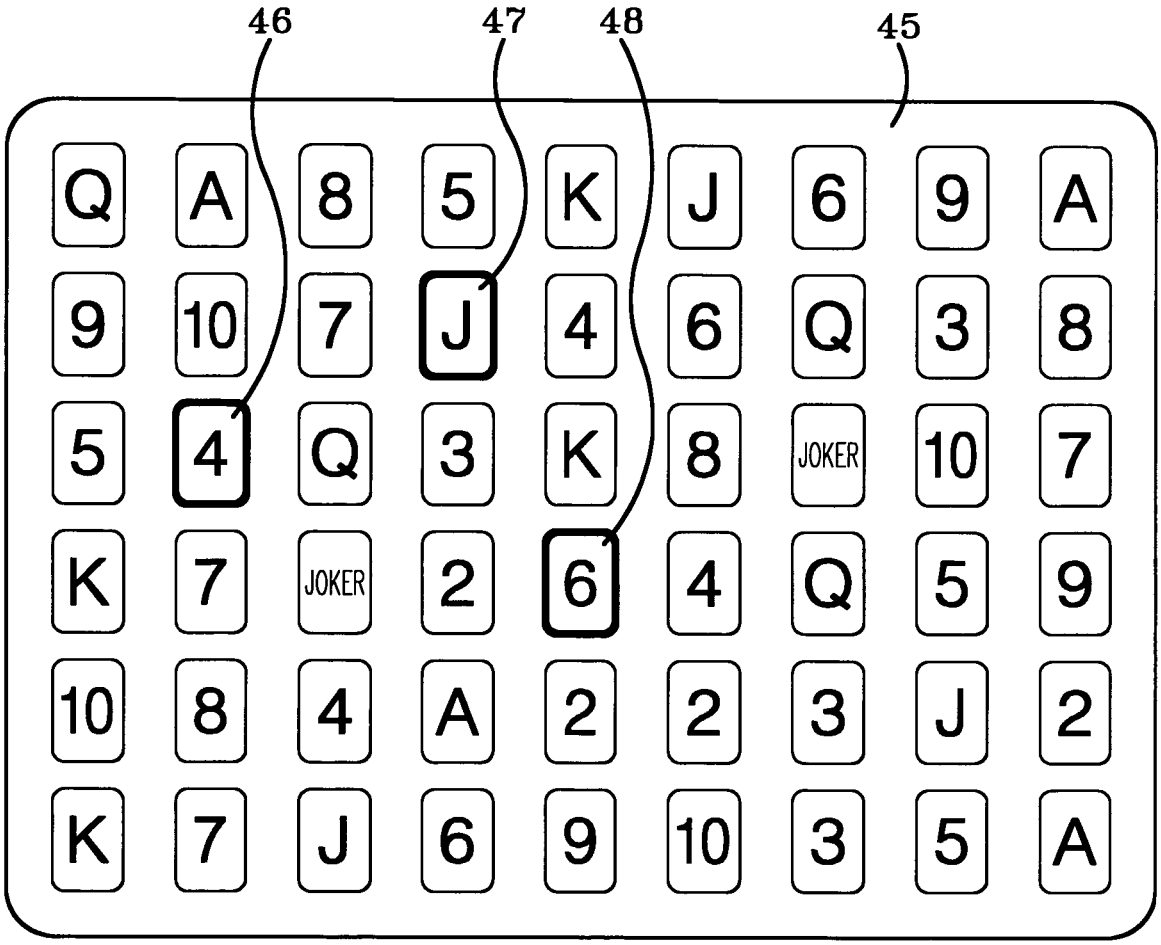
FIG. 7 is an alternate view of the video screen presented to the player after the cards are selected in the Bonus Round.

In accordance with another feature of the game, should the player win the War Round with card 41 being a Joker or other designated wild card, this will automatically direct the player to a Bonus Round shown in FIGS. 5, 6, and 7. The computer will automatically display on the screen, as shown in FIG. 5, fifty-four cards face down consisting of the standard fifty-two cards in a deck and two additional Joker cards. The player preferably is presented with the image as shown in FIG. 5 on a touch sensitive screen 45. The player is entitled to select a predetermined number of cards from screen 45, with the number of picks being determined by the amount of the wager placed at the beginning of the game by the player. For example, if a three card package was selected, the player may pick three cards, if a five card package was selected, the player may pick five cards, and for a seven card package seven cards. Again, this entices the player to select a large card package at the start of the game with the increased wager.

For example, the player has played only a three card package and therefor selects three cards 46, 47, and 48 by touching the screen. This will automatically result in these three cards being turned over and exposed as shown in FIG. 6, with the remaining cards being non-viewable. However it could result in the three selected cards being highlighted in some fashion with the other cards also being turned over as shown in FIG. 7. The selected cards will usually flip over immediately after they are touched by the player, and after all of the chosen cards have been selected and indicated on the screen, the value amounts thereof will be added to the player's credit as shown in FIG. 6. For example, twenty additional points would be credited from the three selected cards 46, 47, and 48 of FIG. 7. FIG. 6 shows the appearance that the video game screen 51 may take at the beginning of the Bonus Round where it displays all the fifty-four face down cards, with the War Round still being shown in a reduced size in the upper corner of the screen at 52.

Thus, the improved game and method of playing the same enables the game of WAR to be played with increased excitement and the ability of the player to increase the amount of winnings. For example, first by winning the War Round with just the higher ranking card, second by increasing the rewards by winning the War Round with an Ace, and third by increasing the winnings by winning the War Round with a Joker. Winning with the Joker enables the player to play the Bonus Round, where again depending upon the initial wager, provides even greater reward points. Furthermore to the casino's or video game owner's benefit, this requires the player to increase the initial bet in order to increase the odds of arriving at a War Round, with the possible greater rewards presented thereby, and furthermore increasing the player's ability to go to the Bonus Round still further increasing the possible rewards.

It is readily understood that the term Bonus Points awarded to the player will in a gaming machine situation equate to money, either by indicating the number of coins which represents the coin denomination of the machine, such as in a twenty-five cent machine each bonus point will equate to twenty-five cents or a portion thereof, or in a dollar machine relate to a dollar or a portion thereof. Thus, a three card package could require one coin, a five card package two coins, and a seven card package three coins at the start of play. Furthermore, it is understood that the game can be played with an actual dealer physically dealing the cards in a manner as discussed above with respect to the video gaming machine without departing from the concept of the invention, and the game could be played by two players without any money being involved, and by a tally of the points awarded to each player be recorded until a certain number of points is reached to declare a winner.

Another option that may be incorporated into the game is that if the player wins a War Round as shown in FIG. 3, the player has the option to play one or more additional War Rounds, each time resulting in the three face down cards and one up card for the dealer and for the player. A predetermined number of War Round options, such as six, could be incorporated into the game. However, once the player loses a War Round the game is over. Likewise, the player has the option to quit at any time after a War Round and take his current winnings and quit, since if the player continues to play additional War Rounds and loses it would affect his winnings, either totally or partially, depending upon the odds and setup of the game. However, the more War Rounds that the player plays, it increases the chances of entering the Bonus Round where considerable bonus points can be obtainable.

It is understood that the term "dealer" can be an actual person or the computer in a video game, or even another player, where two people are playing the game against each other as a friendly game without money being involved. It is also understood that a "wild card" may be a Joker or other designated card.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of playing a wagering card game between at least one player and a dealer comprising the steps of:

the player making a wager to begin play the game;

the player selecting the number of cards to be played, said number being a minimum of three cards or a greater uneven number thereof;

dealing at least five cards to the player and a corresponding number of cards to the dealer even if the number of cards selected initially by the player is three, with each dealer card corresponding to a card of the player;

comparing each of the selected cards of the dealer to the corresponding selected cards of the player wherein the higher ranking card of each pair of compared cards wins; and if the player is the winner of the majority of compared cards, the player is awarded an amount of reward points based upon the amount of the wager;

interrupting the play of the name if the player card and corresponding dealer card of the compared cards are of equal rank resulting in a War Round.

2. The method of playing the card game defined in claim 1 including the step of exposing the value count of the non-selected player and dealer cards which do not enter into the playing of the game.

3. The method of playing the card game defined in claim 1 wherein said method is executed at least in part by an electronic device.

4. The method of playing the card game defined in claim 3 including the step of providing a touch sensitive video screen; and touching certain portions of the screen to select the number of cards desired to be played by the player at the start of the game.

5. A method of playing a wagering card game between at least one player and a dealer comprising the steps of:

the player making a wager to begin play the game;

the player selecting the number of cards to be played, said number being a minimum of three cards or a greater uneven number thereof;

dealing at least the number of selected cards to the player and the same number of cards to the dealer, with each dealer card corresponding to a card of the player;

comparing each card of the dealer to the corresponding card of the player wherein the higher ranking card of each pair of compared cards wins, and wherein if the player is the winner of the majority of compared cards, the player is awarded an amount of reward points based upon the amount of the wager;

interrupting the play of the game if the player card and corresponding dealer card of the compared cards are of equal rank resulting in a War Round;

proceeding to the War Round which includes the steps of:

dealing at least one card face down to each of the player and to the dealer;

dealing an additional card face up and exposed to each of the player and the dealer;

terminating the War Round if the exposed dealer card is of greater rank than the exposed player card;

exposing the value of the at least one dealer card and the at least one player card initially dealt face down; and if the player's additional face up card is of a greater rank than the dealer's additional face up card the player is the winner of the War Round; and awarding points to the player based upon at the at least one card initially dealt face down in the War Round.

6. The method of playing the card game defined in claim 5 including the step of awarding points to the player equal to the value of the previous card dealt face down to the player in the War Round if the player wins the War Round with any card other than an Ace or a Joker.

7. The method of playing the card game defined in claim 6 including the step of dealing a plurality of cards face down to the player and to the dealer in the secondary War Round; and awarding points to the player equal to the total value of the said previous cards dealt face down to both the player and dealer in the War Round if the player wins the secondary War Round with an Ace.

8. The method of playing the card game defined in claim 6 including the step of proceeding to a Bonus Round if the player wins the War Round with a Joker.

9. The method of playing the card game defined in claim 8 in which the Bonus Round includes the steps of:

providing a plurality of face down cards;

the player choosing a number of said face down cards awarding points to the player based upon the value of the chosen cards.

10. The method of playing the card game defined in claim 9 in which the Bonus Round further includes the step of determining the number of cards chosen by the player based upon the initial wager of the player at the start of the game.

11. The method of playing the card game defined in claim 9 in which the Bonus Round first includes the steps of providing a standard 52 deck of cards with at least one Joker which are placed face down, from which deck the player chooses the number of cards.

12. The method of playing the card game defined in claim 9 in which the Bonus Round further includes the step of exposing only the value of the cards chosen by the player.

13. The method of playing the card game defined in claim 5 including the step of selecting to play another War Round upon the player winning the initial War Round.

14. A method of playing a wagering card game between at least one player and a dealer comprising the steps of:

the player making a wager to begin play the game;

the player selecting the number of cards to be played, said number being a minimum of three cards or a greater uneven number thereof;

dealing at least the number of selected cards to the player and the same number of cards to the dealer, with each dealer card corresponding to a card of the player;

comparing each card of the dealer to the corresponding card of the player wherein the higher ranking card of each pair of compared cards win wherein if the player is the winner of the majority of compared cards, the player is awarded an amount of reward points based upon the amount of the wager;

interrupting the play of the game if the player card and corresponding dealer card are of equal rank resulting in a War Round;

proceeding to the War Round which includes the steps of:

dealing at least one card face down to each of the player and the dealer;

dealing at least one additional card face up to each the player and the dealer;

terminating the War Round if the exposed dealer card is of greater rank than the exposed player card; and declaring the player the winner if the player's additional face up card is of a greater rank than the dealer's additional face up card the player; and proceeding to a Bonus Round if the player wins the War Round with the additional face up card being a preselected wild card.

15. The method of playing the card game defined in claim 14 including the step of awarding points to the player equal to the value of the at least one card dealt face down to the player in the War Round if the player wins the War Round with any card other than an Ace or a Joker.

16. The method of playing the card game defined in claim 15 including the step of awarding points to the player equal to the total value of the at least one card dealt face down to both the player and dealer in the War Round if the player wins the War Round with an Ace.

17. The method of playing the card game defined in claim 14 in which the Bonus Round includes the steps of:

providing a plurality of additional face down cards;

the player choosing a number of said additional face down cards; and awarding points to the player based upon the total value of the number of cards chosen by the player.

18. The method of playing the card game defined in claim 17 in which the Bonus Round further includes the step of determining the number of cards chosen by the player based upon the initial wager of the player at the start of the game.

19. The method of playing the card game defined in claim 17 in which the Bonus Round first includes the steps of providing a standard 52 deck of cards with at least one Joker which are placed face down, from which deck the player chooses the number of cards.

20. The method of playing the card game defined in claim 14 including the step of providing a touch sensitive video screen; and touching certain portions of the screen for carrying out the previous method steps.

* * * * *